United States Patent [19]

Chuan-Tien

[11] Patent Number: 4,861,026

[45] Date of Patent: Aug. 29, 1989

[54] WISHING GAME

[76] Inventor: Chuang Chuan-Tien, No. 2, Lane 174, Ta-Hsing Street, Tainan, Taiwan

[21] Appl. No.: 51,780

[22] Filed: May 20, 1987

[51] Int. Cl.[4] ..... A63B 67/00; A63B 71/00; A63F 9/00

[52] U.S. Cl. ..... 273/1 GD; 273/1 M; 273/140

[58] Field of Search ..... 273/140, 142 H, 1 M, 273/1 GD

[56] References Cited

U.S. PATENT DOCUMENTS

| | | | |
|---|---|---|---|
| 818,895 | 4/1906 | Kuhn | 273/142 H |
| 1,473,603 | 11/1923 | Anderson | 273/140 |
| 4,432,544 | 2/1984 | Wakimura | 273/140 |
| 4,603,860 | 8/1986 | Wey | 273/140 |

FOREIGN PATENT DOCUMENTS

| | | | |
|---|---|---|---|
| 2422878 | 12/1979 | France | 273/140 |
| 122855 | of 1911 | United Kingdom | 273/140 |

*Primary Examiner*—Richard C. Pinkham
*Assistant Examiner*—Gary Jackson
*Attorney, Agent, or Firm*—Clifford A. Poff

[57] ABSTRACT

A fishing game toy containing at least two rotatable pans to allow two or more participants to compete simultaneously. A plurality of game pieces are disposed in the rotatable pans. The game pieces rise and fall in sockets in the pans. The pans are driven by a drive that includes an idler gear so that all pans rotate in the same relative direction, and provide moving targets for game participants to attempt to catch.

7 Claims, 7 Drawing Sheets

WISHING GAME

BACKGROUND OF THE INVENTION

1. Field of the Invention: The present invention relates generally to fishing toys, and, more particularly, to an multiple-pool type fishing toy in which two or more participants may participate simultaneously.

2. Description of the Prior Art: A wellknown toy known as a fishing toy, provides that game targets formed in the likeness of fish and frogs, for example, can be lifted by means of a toy fishing rod having a magnet attached to an end thereof while the target is raised but before it falls downward in the socket of a rotatable pan. Rotation of the pan causes the game targets to raise and fall in an alternating fashion in the sockets in the pan. A plurality of fishing rods are provided for participating in the game. The recreational effects of the toy can be enhanced by competition.

However, the design of the known fishing toy provided only a single rotatable pan; thus significantly limiting the recreational use of the toy. In competition only one participant can use the toy at one time. Uniform and exact competition periods for each participant are difficult to control.

SUMMARY OF THE INVENTION

It is accordingly an object of the present invention to provide a fishing toy which will allow a number of participants to compete in the fishing game simultaneously, thereby enhancing the recreational effects of the fishing toy.

In accordance with the construction of the fishing toy of the present invention, at least two rotatable pans are supported on one supportive body and driven simultaneously by one drive motor. Different type of game targets can be provided in the rotatable pans to enhance interest in the game.

According to the present invention there is provided at least two rotatable pans in a single support body and drive gear means includes a drive gear for the pans in mesh with at least one idler that in turn meshes with the teeth on two pans.

It is therefor a principle object of the present invention to provide a fishing toy of a multiple pool type having a plurality of pans which can be rotated simultaneously such that a number of participants in the game can simultaneously use the fishing toy game.

BRIEF DESCRIPTION OF THE DRAWINGS

These objects and features as well as others of the invention can be better understood when the following detailed description of the present invention is read in conjunction with the accompanying drawings in which.

DETAILED DESCRIPTION OF THE PREFERRED EMBODIMENTS

Figure 1:
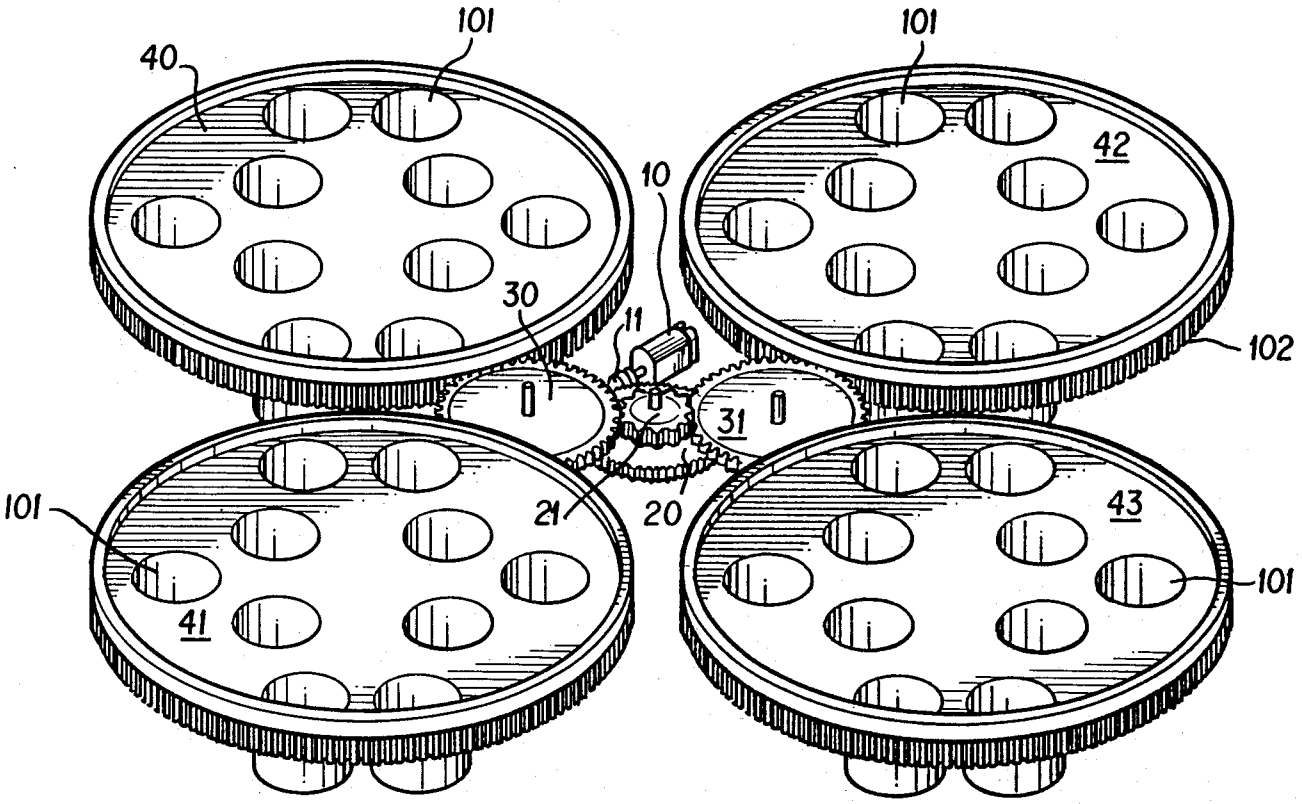
FIG. 1 is a schematic illustration of a first embodiment of the present invention having four rotatable pans.
Figure 2:
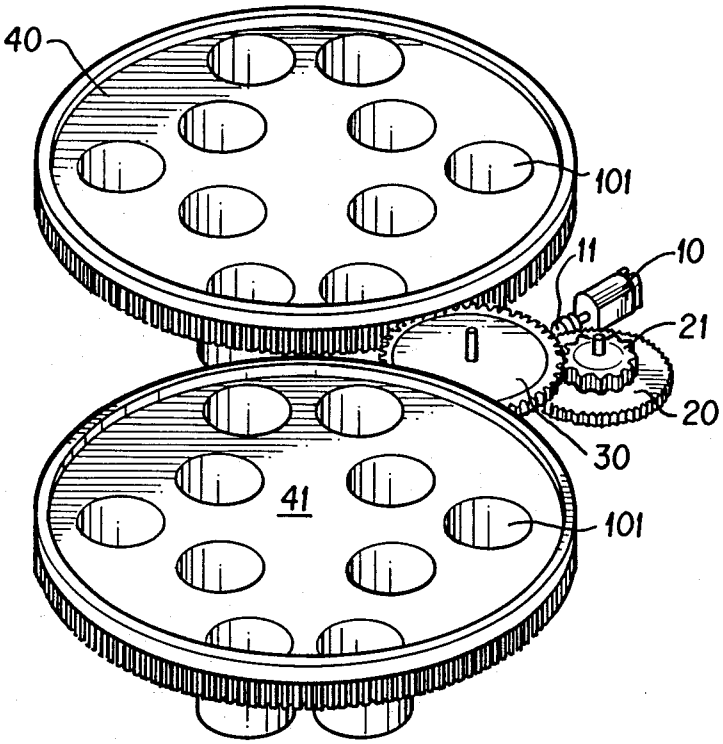
FIG. 2 is a schematic illustration of an alternative embodiment of the present invention having two rotatable pans.
Figure 3:
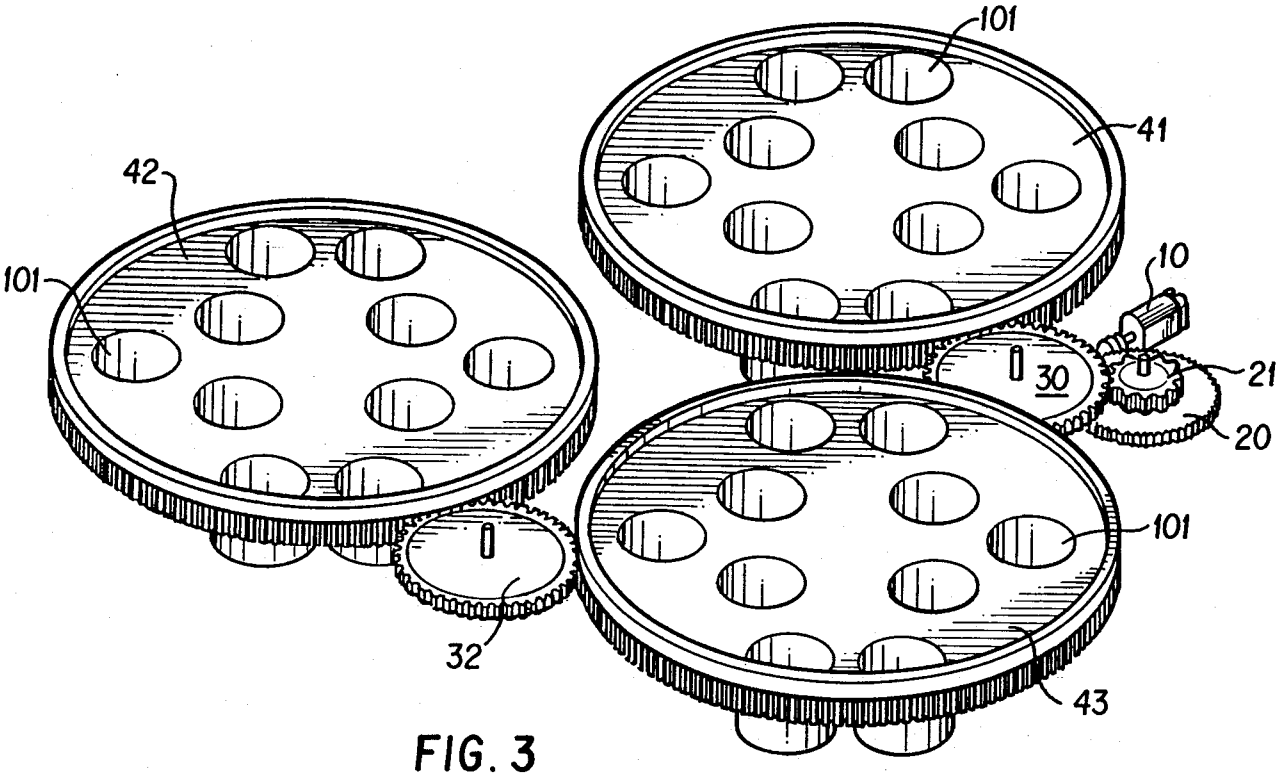
FIG. 3 is a schematic illustration of a third embodiment of the present invention having three rotatable pans.
Figure 4:
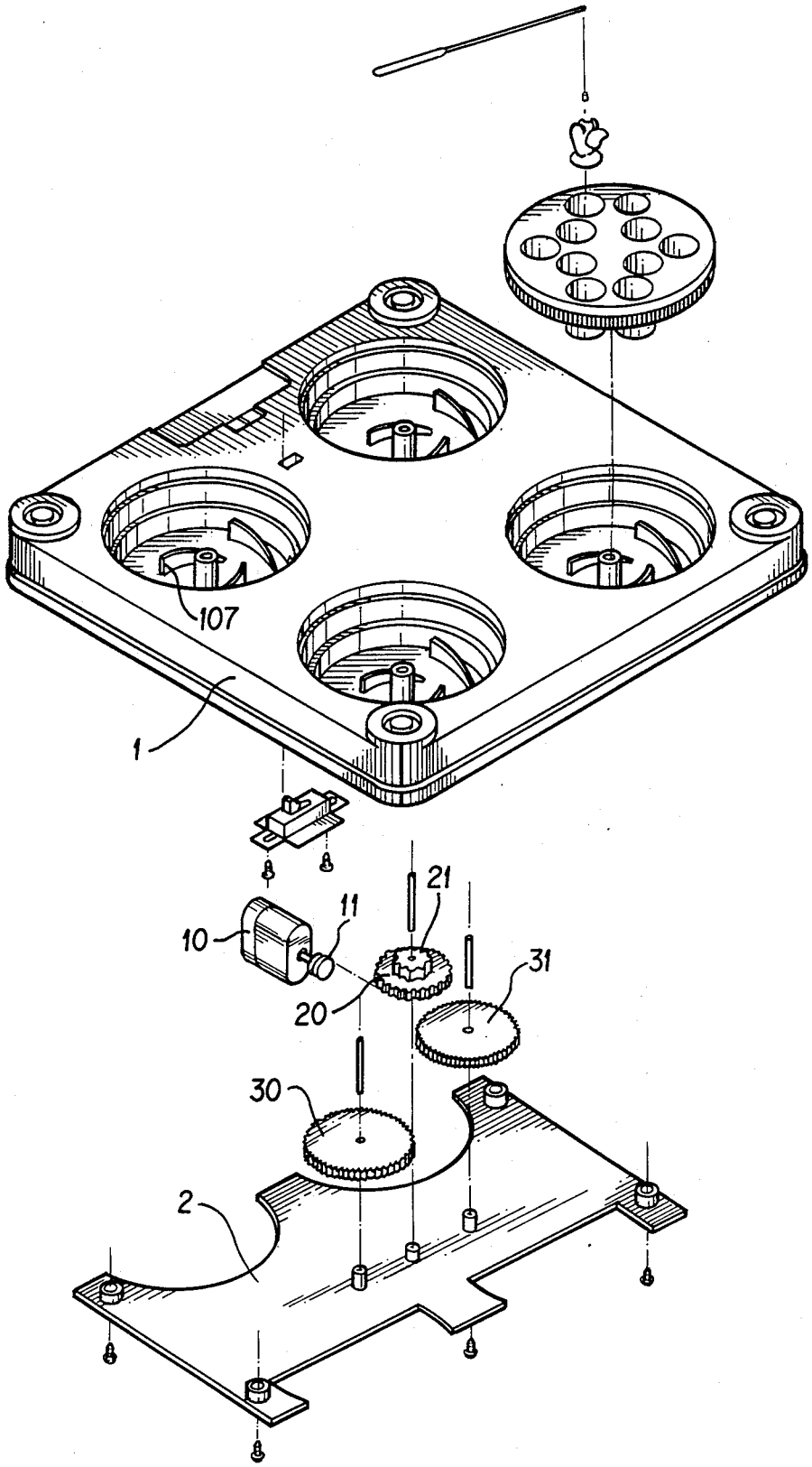
FIG. 4 is an exploded view of the four-pan fishing toy embodiment similar to that of FIG. 1.
Figure 5:
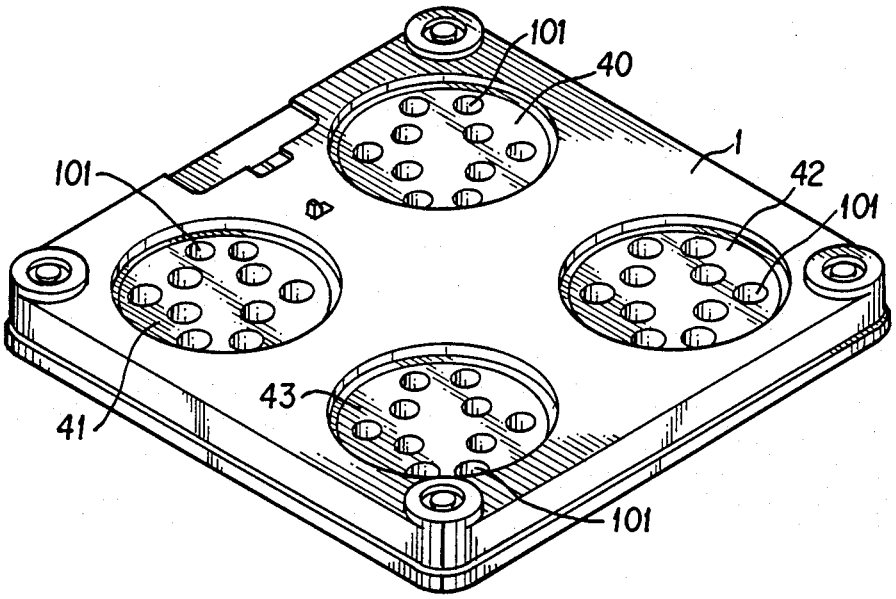
FIG. 5 is a perspective illustration of the fishing toy of FIG. 4.

As shown in FIGS. 1–4 of the drawings, the fishing game of the present invention includes a motor 10 having a spindle on which there is provided a worm gear 11 that meshes with a gear 20. Gear 20 is provided to rotate pinion 21 which in turn meshes with at least one idler gear. In the embodiment of FIG. 1, two idler gears 30 and 31 mesh with pinion 21. In the embodiments of FIGS. 2 and 3, one idler gear 30 meshes with pinion 21. It will be observed in the embodiments of FIGS. 1, 3, and 4, there are two idlers. In the four pan arrangement of fishing games shown in FIGS. 1 and 4, two idlers identified by reference numerals 30 and 31 mesh with pinion 21 while in the embodiment of FIG. 3, one idler gear 30 meshes with pinion 21 and a further idler gear identified by reference numeral 32 is provided to insure simultaneous rotation of the pans as will be described in greater detail hereinafter. To provide a fishing toy construction of a four pool type, as shown in FIGS. 1, 4 and 5, the two idler gears 30 and 31 mesh with pinion gear 21 which is disposed in the central portion of the support body 100. Each of the idler gears 30 and 31 mesh with two rotatable pans 40, 41, and 42, 43, respectively. As can be seen from FIG. 1, the rotational pans 40–43, each contain a plurality of vertically extending sockets 101 into which game targets can be located. The pans each have an annular peripheral surface having teeth 102 thereon. These teeth mesh with idler gears as shown by the various embodiments of FIGS. 1, 2, 3, and 4.

Figure 6:
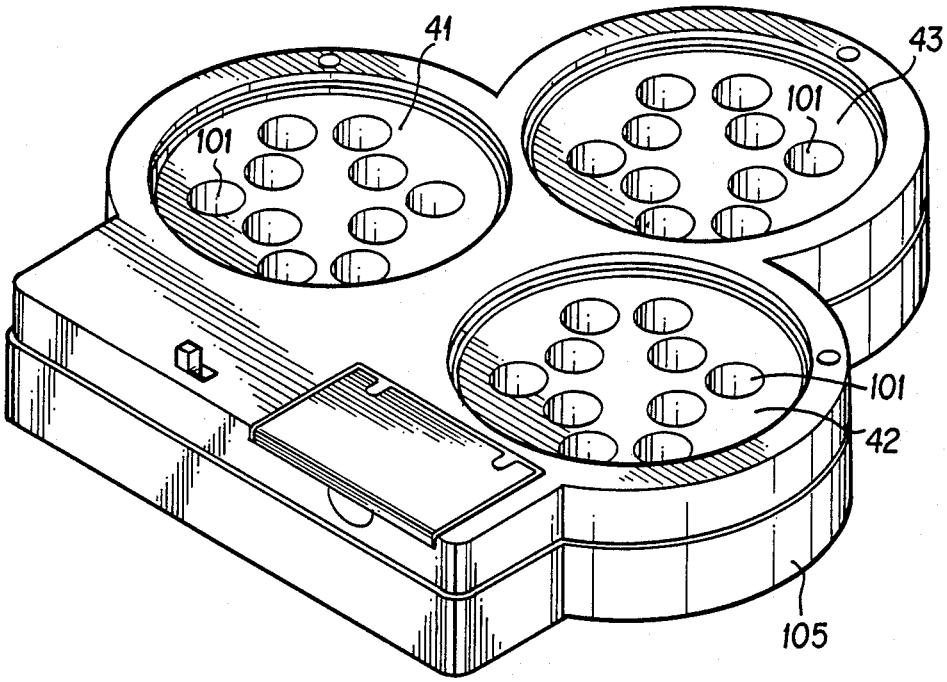
FIG. 6 is a perspective illustration of the three-pan embodiment of the present invention.
Figure 7:
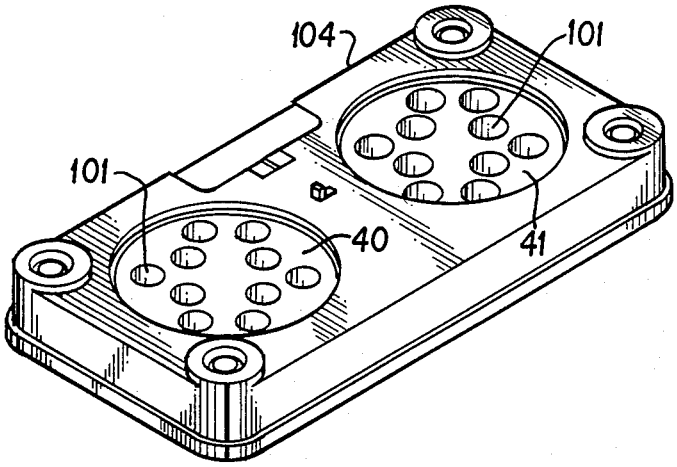
FIG. 7 is a perspective illustration of the two-pan embodiment of the present invention.

The four pan embodiment of the invention as shown in FIG. 5 includes a support body 1 having four cavities therein to rotatably support the pans 40–43. In the embodiment shown by FIGS. 2 and 7, a support body 104 is provided with two cavities, wherein pans 40 and 41 are supported. In the embodiment of the invention shown in FIG. 6, a support body 105 is provided with three cavities wherein pans 41–43 are supported. As can be seen from the illustration of FIG. 4, in the base of the cavities provided in the support body, there is located upwardly incline tracks 107 that cause the game pieces to rise and fall in the sockets of the pans while the pans simultaneously rotate.

In view of the foregoing, it can be seen that the fishing toy of the present invention may comprise different arrangement of drives in cooperation of different number of pans. This arrangement has been found to be superior to conventional fishing toys because participation by a number of players can take place through allocation of a player for each pool.

Figure 8:
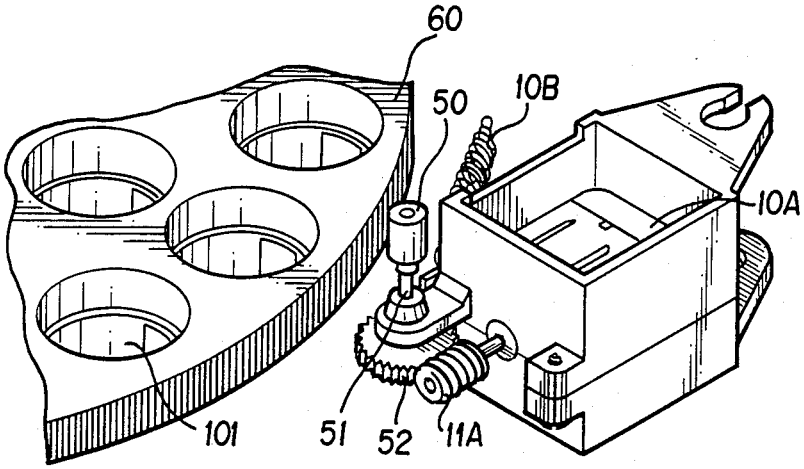
FIG. 8 is a cut-away view of a further embodiment of the present invention.

In FIG. 8, there is illustrated a further embodiment of the present invention wherein a motor 10A is mounted in a suitable housing and has a spindle on which there is mounted a worm gear 11A. The worm gear in turn meshes with a gear 52 which is mounted on a rod 51. A rubber wheel 50 is attached to the rod 51. The rubber wheel engages with a tooth peripheral surface of pan 60 to drive the pan for rotation in the support body. When rotation of the pan 60 is stopped, the rubber wheel 50 exerts a force comprised of two components; one component being normal to the periphery of the pan and the other force being tangential to the annular edge of the pan containing the teeth. This force is a result of a spring 10B to protect the motor. In the event the pan is inadvertently stopped by the person using the toy, a tangental component of force will be exerted on and slightly stress the spring so that the rubber wheel 50 disengages from the tooth periphery of the pan to prevent the motor from being stopped. In normal use of the toy, the force component which is normal to the tooth periphery of the pan maintains contact between the rubber wheel 50 and the pan 60 thus maintaining continuous rotation of the pan. This embodiment of the present invention has the advantage that the longevity of the motor in the toy will be longer than the motor used in conventional fishing toys.

The embodiments of fishing toys according to the present invention utilize different drive arrangements to produce the simultaneous rotation of the various differently numbered pans. The drive arrangements are superior over conventional drives in known fishing toys because of the usefulness provided for the users of the toy. The fishing toy according to the present invention can be used by a number of game participants simultaneously rather than restricting use of the game by the group to a sequential order of the persons comprising the group. The present invention also offers the advantage that the period for participating in the game can be controlled more uniformly and accurately while the participants simultaneously participate in the game. Thus it can be seen that the recreational effect as well as the reaction capability of the game participants can be exercised through competition. In addition, the interest by the players of the game can be enhanced by using various different game targets such as game targets having the shape of a shrimp, crab, fish, and frog.

While the present invention has been described in accordance with the preferred embodiments of the various figures, it is to be understood that other similar embodiments may be used, or modifications and additions may be made to the described embodiment for performing the same functions of the present invention without deviating therefrom. Therefore, the present invention should not be limited to any single embodiment, but rather construed in breadth and scope in accordance with the recitation of the appended claims.

I claim:

1. A fishing game toy comprised of:

a support body having at least two cavities;

a plurality of pans each having a plurality of vertically extending sockets, said pans being supported for rotation in the cavities of said support body, each of said pans including an annular peripheral surface having teeth thereon; a plurality of game targets positioned in the sockets of said pans for access by a number of players corresponding to the number of such pans;

means supported by the support body for displacing individual ones of the plurality of game targets in the sockets of each pan upon rotation thereof; and a drive means including at least one idler gear engaged with the teeth on the annular peripheral surface of said pans for simultaneously rotating the pans in the same relative direction of rotation.

2. The fishing game according to claim 1 wherein said plurality of pans is further defined to comprise an even number of pans, and wherein said idler gear and said drive means meshes with said teeth of pairs of said even numbered pans, and wherein every such one idler gear is driven by a pinion gear which is in turn driven by a drive motor.

3. The fishing game according to claim 1 wherein said plurality of pans is further defined to comprise an odd number of at least three pans and wherein said idler gear comprises a plurality of idler gears such that one of the idler gears meshes with the teeth of one pair of pans and a second of said idler gears with the teeth of a pan of said one pair of pans and with the teeth of an odd numbered one of said pans.

4. The fishing game toy of claim 1 wherein said teeth on the annular peripheral surface of said pans comprise gear teeth to mesh with said drive means.

5. The fishing game toy of claim 4 wherein said drive means includes a drive motor having a drive spindle, a worm gear on said drive spindle and gear means meshing with said worm for rotation at least one of said pans.

6. The fishing game toy of claim 1 wherein said drive means includes a rubber wheel for meshing engagement with the teeth on the annular periphery of one of said pans.

7. The fishing game toy of claim 6 further including resilient means for urging said rubber wheel into engagement with the teeth on the annular periphery of one of said rotatable pans.

* * * * *

UNITED STATES PATENT AND TRADEMARK OFFICE

CERTIFICATE OF CORRECTION

PATENT NO. : 4,861,026

DATED : August 29, 1989

INVENTOR(S) : Chuang Chuan-Tien

It is certified that error appears in the above-identified patent and that said Letters Patent is hereby corrected as shown below:

The Title of the Invention should be changed from "WISHING GAME" to --FISHING GAME--.

Signed and Sealed this

Sixteenth Day of October, 1990

*Attest:*

HARRY F. MANBECK, JR.

*Attesting Officer*

*Commissioner of Patents and Trademarks*